US007686363B2

(12) United States Patent
Karlsson

(10) Patent No.: US 7,686,363 B2
(45) Date of Patent: Mar. 30, 2010

(54) CONTAINER LIFT

(75) Inventor: Gösta Karlsson, Killeberg (SE)

(73) Assignee: Elmhults Konstruktions AB, Almhult (SE)

( * ) Notice: Subject to any disclaimer, the term of this patent is extended or adjusted under 35 U.S.C. 154(b) by 103 days.

(21) Appl. No.: 11/571,715

(22) PCT Filed: Jul. 4, 2005

(86) PCT No.: PCT/SE2005/001091

§ 371 (c)(1),
(2), (4) Date: Jan. 28, 2008

(87) PCT Pub. No.: WO2006/004531

PCT Pub. Date: Jan. 12, 2006

(65) Prior Publication Data

US 2009/0015025 A1 Jan. 15, 2009

(30) Foreign Application Priority Data

Jul. 5, 2004 (SE) ..... 0401744

(51) Int. Cl.
*B66C 1/66* (2006.01)

(52) U.S. Cl. ..... 294/81.21; 294/81.1; 294/81.53

(58) Field of Classification Search ..... 294/81.53, 294/81.21, 81.1, 81.2, 81.4, 81.54
See application file for complete search history.

(56) References Cited

U.S. PATENT DOCUMENTS 3,709,543 A * 1/1973 Tax et al. ..... 294/81.2
5,280,980 A 1/1994 Coatta
6,145,903 A * 11/2000 Stinis ..... 294/81.21
6,312,213 B1 * 11/2001 Stinis ..... 414/803
2005/0225104 A1 * 10/2005 Lim et al. ..... 294/81.1

FOREIGN PATENT DOCUMENTS

DE 19516520 7/1996
WO 9929613 6/1999
WO 0162657 8/2001

OTHER PUBLICATIONS

International Preliminary Report on Patentability.

* cited by examiner

*Primary Examiner*—Paul T Chin
(74) *Attorney, Agent, or Firm*—Renner, Otto, Boisselle & Sklar LLP

(57) ABSTRACT

A container lift intended to lift two containers arranged longitudinally that comprises a primary frame (4), external transverse beams (7, 8) arranged on the primary frame (4) with external locking means (9) for locking the short sides of the containers that face away from each other, saddles (5, 6) arranged on the primary frame (4) such that they can be displaced, locking means (9) arranged on the lower surfaces of the saddles (5, 6) for locking two containers with their short sides facing towards each other. At least one of the saddles (5, 6) intended to lock the short sides of the containers that are facing each other can be displaced in a principally sideways direction relative to the primary frame in order to be able to lift displaced containers or containers that are twisted relative to each other.

7 Claims, 4 Drawing Sheets

CONTAINER LIFT

The invention concerns a container lift intended to be able to lift two containers arranged longitudinally. The invention comprises a primary frame, external transverse beams arranged on the primary frame with external locking means for locking the short sides of the containers that face away from each other, saddles arranged on the primary frame such that they can be displaced, inner locking means arranged on the lower surface of the saddles for locking of the short sides of the containers that face towards each other.

It can today be said that the use of containers dominates the transport of goods in large quantities. Thus the collection of containers for filling or for emptying requires ever-greater areas, and the containers are for this reason stacked on top of each other, and with gaps between them that are as small as possible. A small displacement or twisting of one container relative to another creates problems for a crane operator in correctly placing a container lift for lifting the container intended. This is a particularly serious problem for container lifts of the type known as "twin lift". A twist or a displacement of two containers relative to each other may make it impossible to correctly place the lift and lock the containers. Small tolerances apply, a few tens of millimeters, when using locking of the type known as "twist lock".

One aspect of the present invention is thus to provide a container lift of the twin lift type with which it is possible to handle two containers that are not aligned with each other.

The present invention is for this reason characterised by at least one of the saddles that are intended to lock the short sides of the containers that face each other being arranged such that it can be displaced in a direction that is principally sideways relative to the primary frame.

According to one embodiment of the invention, the saddle that belongs to one of the containers can be displaced in a sideways direction independently of the saddle that belongs to the second container.

According to one embodiment of the invention, the displacement is arranged to be carried out by a hydraulic system of piston-cylinder arrangements.

According to one particularly advantageous embodiment of the invention, the saddle that belongs to each of the containers is arranged such that it can be displaced with two piston-cylinder arrangements, the pistons of which are connected to each other and one cylinder is fixed attached to the primary frame and the second cylinder is fixed attached to the saddle; or whose cylinders are connected with each other and one piston is fixed attached to the primary frame and the second piston is fixed attached to the saddle.

The invention will now be described in more detail in the form of examples with reference to the drawings, where FIG. 1*a* shows a side elevation of a container lift according to the invention;

FIG. 1*b* shows a plan of a container lift according to the invention;

FIG. 1*c* shows a view from one short side of a container lift according to the invention;

Figure 4A:
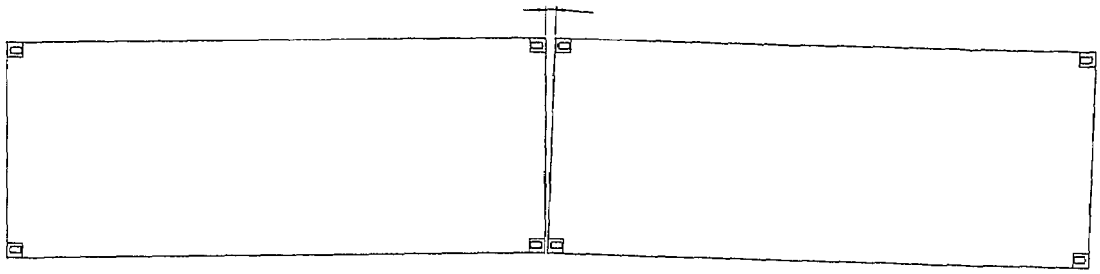
Figure 4B:
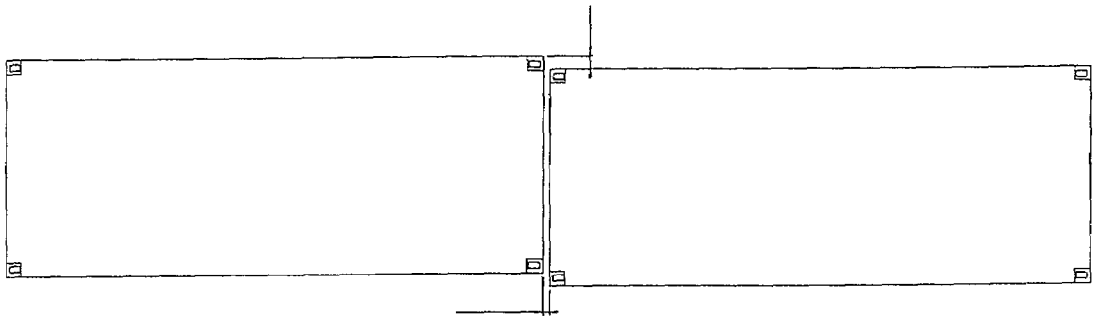
Figure 4C:
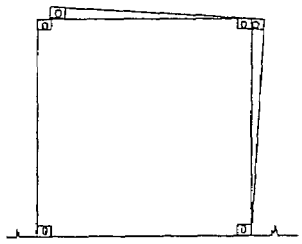
Figure 5:
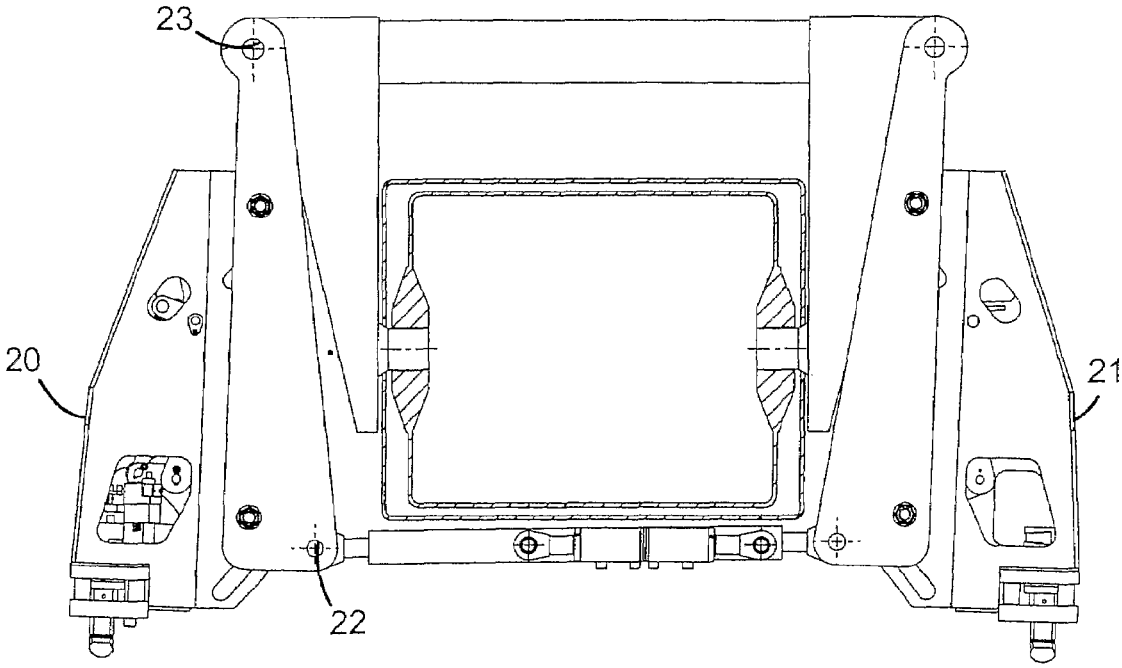

FIG. 4*a* shows schematically one possible position of two containers that can be lifted with a container lift according to the invention;

FIG. 4*b* shows schematically a second possible position of two containers that can be lifted with a container lift according to the invention;

FIG. 4*c* shows schematically a further possible position of two containers that can be lifted with a container lift according to the invention;

FIG. 5 shows a further embodiment of a saddle that is part of a container lift according to the invention, at a position in which the locking means is displaced to the left relative to the primary frame.

Figure 1A:
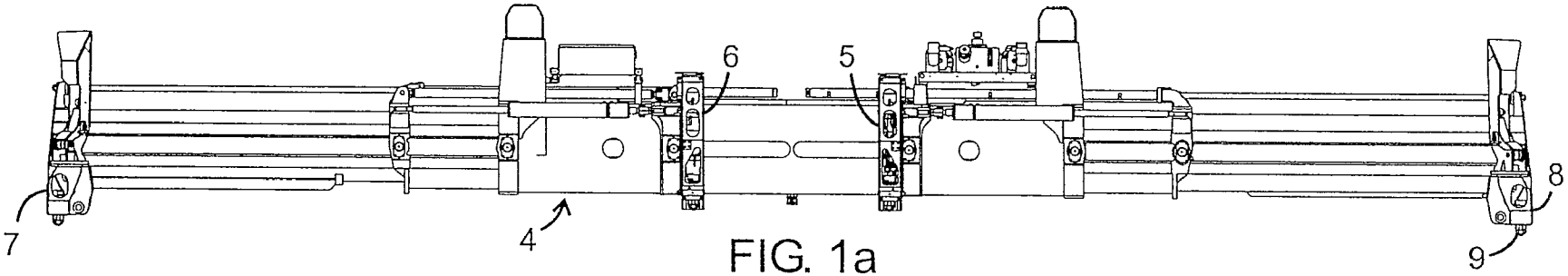
Figure 1B:
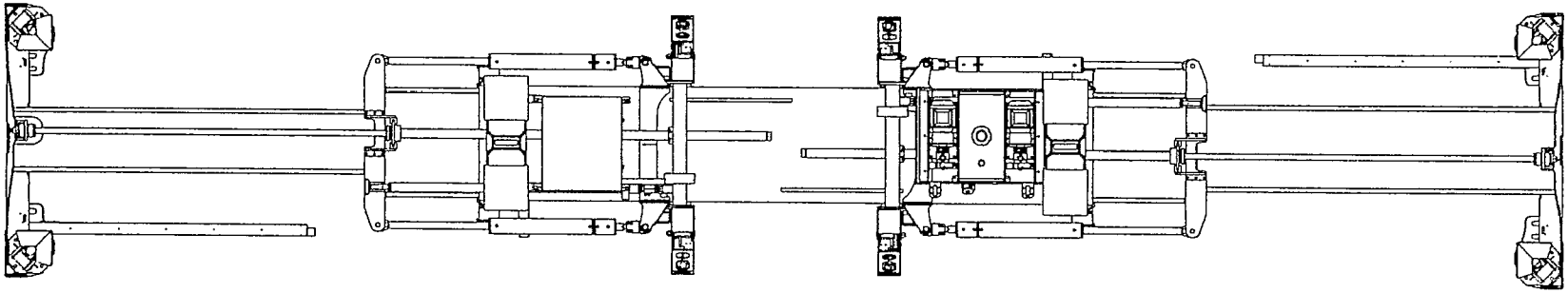
Figure 1C:
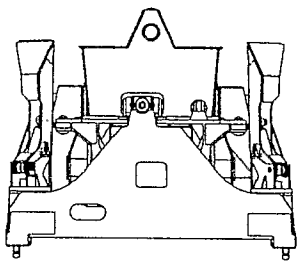
Figure 2:
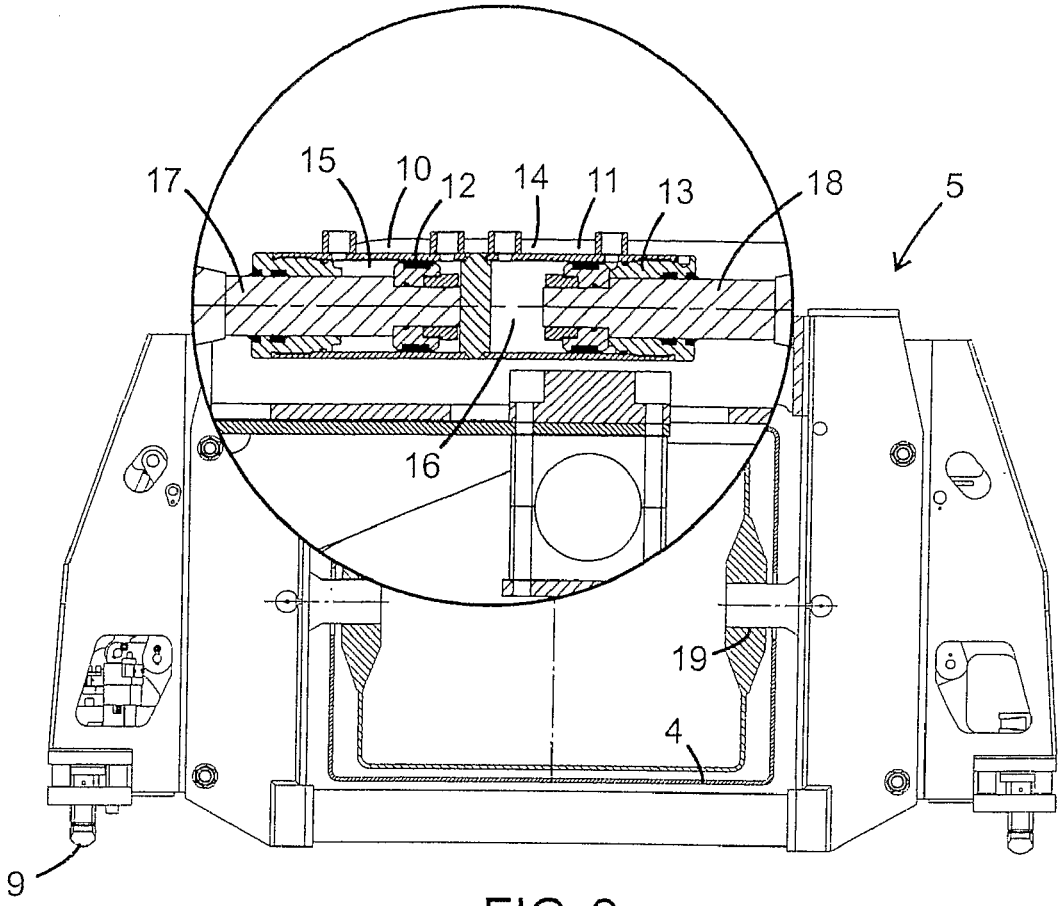
FIG. 2 shows a cross-section of a saddle that is part of a container lift according to the invention, at a central location relative to the primary frame.
Figure 3:
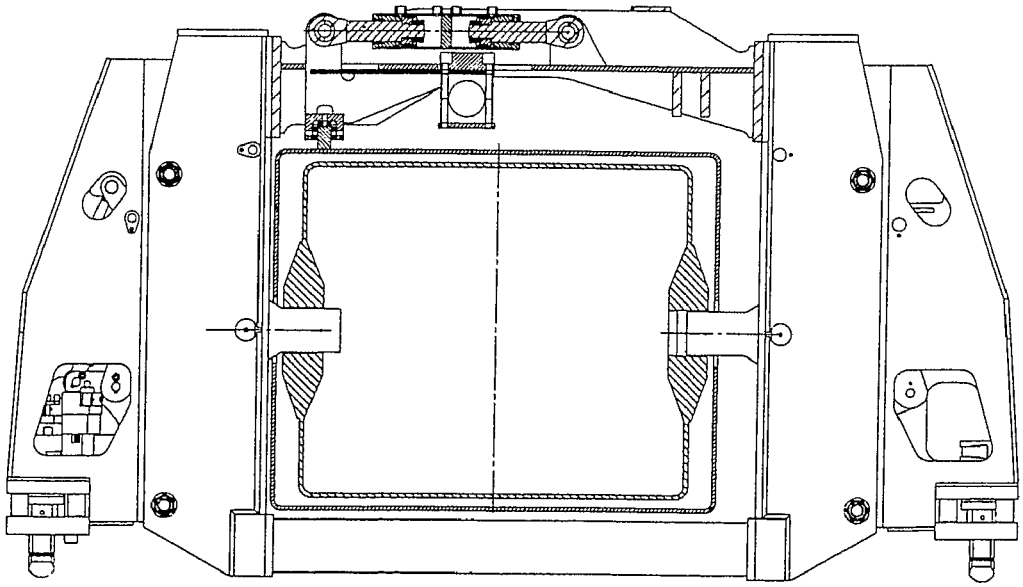
FIG. 3 shows a cross-section of a saddle that is part of a container lift according to the invention, in a position that is displaced to the right relative to the primary frame.

FIGS. 1*a-c* show a container lift of twin lift type intended to be able to carry two containers and comprising a primary frame 4 on which saddles 5, 6, also known as "twin lift boxes", having the form of rings are arranged. These are shown in FIGS. 2 and 3 mounted in bearings on each side of the primary frame 4 through pegs 19. The container lift also demonstrates at each end two outer transverse beams 7, 8. The container lift can be locked in a fixed position and it can support containers with the aid of known locking means 9, known as "twistlock" devices, at each end of each transverse beam 7, 8 and saddle 5, 6 on the lower surfaces of these. The container lift with or without containers can be lifted and displaced in a manner that is known and acknowledged within the prior art using, for example, a crane, not shown in the drawing.

The primary frame is constituted by a design that makes it possible to adapt the distance between the locking means such that containers of different lengths can be locked in place and lifted. Furthermore, the distance between two containers that have been lifted can be altered during the lift. These designs are not described in any further detail here.

As is shown in FIGS. 2 and 3, the saddles 5, 6 can be displaced in a sideways direction relative to the primary frame 4 of the container lift through a hydraulic system. This consists of two interacting piston-cylinder arrangements 10, 11 arranged transversely in a horizontal direction relative to the longitudinal direction of the container lift. One piston 12 of the piston-cylinder arrangement 10 is fixed attached through its piston rod 17 to the primary frame 4, while the piston 13 of the second piston-cylinder arrangement is fixed attached to the saddle through its piston rod 18. The two piston rods 17, 18 are thus directed in opposite directions and can move freely away from each other and towards each other. The cylinder housing 14 consists of two cylinder chambers 15, 16 arranged subsequent to each other, in each of which chambers is arranged one of the pistons 12, 13. The cylinder housing 14 is mounted as a floating unit, i.e. it is not attached to anything. Each of the cylinder chambers has two connections for the controlled supply and withdrawal of hydraulic fluid. Thus, each piston-cylinder arrangement has two positions, one with an extended piston and one with a withdrawn piston. Since the piston-cylinder arrangements are independently controlled, four different combinations of these positions are possible. If one piston is extended and the other withdrawn, as is shown in FIG. 2, independently of which, the saddle will be centred in a sideways direction relative to the primary frame. If both pistons are extended, as is shown in FIG. 3, the saddle will be displaced to the right relative to the primary frame. If both pistons are withdrawn, the saddle will be displaced to the left relative to the primary frame.

Each saddle (5, 6) that belongs to a container can in an embodiment that is not shown in the drawings be arranged such that it can be displaced with two piston-cylinder arrangements (10, 11), the pistons of which are instead connected with each other, with one cylinder fixed attached to the primary frame and the other cylinder fixed attached to the saddle, achieving the same effect.

Through the presence of equivalent hydraulic system in the two saddles that are facing each other, several positions can be achieved that are suitable for several different types of "erroneous" positions of two containers arranged in a longitudinal direction. Through displacing both saddles in the same direction, the container lift can land on and lock containers that are not placed with their central lines parallel, i.e. containers that are rotated relative to each other. If only one of the saddles is displaced, or if the saddles are each displaced in different directions, the container lift can land on and lock containers whose central lines are parallel to each other at a distance that is equivalent to the mutual displacement of the saddles. The displacement thus controls the magnitude that this distance may reach. Since only the saddles are displaced and not the cross beams that are arranged at the opposite ends, an "angular error" relative to the actual locations of the containers arises when the saddles are displaced. The locking means, i.e. the twist lock, however, possesses a margin of play that compensates the "angular errors" to which the relatively moderate displacements give rise.

The problem of containers that are located at an angle relative to each other, illustrated in FIG. 4*c*, also is solved through one of the saddles being displaced, or by the saddles each being displaced in different directions.

In order to avoid the saddles becoming wedged with the pegs 19 through what is known as the "chest of drawers" effect, a further piston-cylinder arrangement (not shown in the drawing) can be arranged under each of the saddles in order to be able to raise or lower the saddles.

FIG. 5 shows a further embodiment of the invention in which each saddle comprises a locking means holder 20, 21 arranged such that it can swing on each side of the primary frame. The locking means shown in FIG. 5 are displaced to the left in the drawing through the locking means holders being able to swing around an axis 23 at their upper ends, which axis is parallel to the primary frame. The piston-cylinder arrangements are arranged in this embodiment under the primary frame. The piston 12 of one piston-cylinder arrangement 10 is attached through its piston rod 17 to the primary frame 4, while the piston 13 of the second piston-cylinder arrangement 11 is jointed attached through its piston rod 18 to both of the locking arrangement holders 20, 21 at the axes 22. The displacements or movements of the locking means holders are controlled in a manner that is equivalent to that in the embodiment according to FIGS. 2 and 3.

The extent of protection is not to be regarded as limited to the examples described in the description: it includes a number of embodiments that are conceivable within the framework of the claims for one skilled in the arts.

The invention claimed is:

1. A container lift intended to lift two containers arranged longitudinally that comprises a primary frame having a longitudinal axis, external transverse beams arranged on the primary frame with external locks for locking the sides of the containers that face away from each other, saddles arranged on the primary frame such that they can be displaced, locks arranged on the saddles for locking the sides of the containers facing towards each other, wherein at least one of the saddles can be displaced in a sideways direction transverse to the longitudinal axis and the saddles are also arranged on the primary frame for movement along the longitudinal axis.

2. The container lift according to claim 1, wherein the saddle that belongs to a first container can be displaced sideways independently of the saddle that belongs to a second container.

3. The container lift according to claim 2, wherein the displacement is carried out by a hydraulic system of piston-cylinder arrangements.

4. The container lift according to claim 3, wherein at least part of each saddle is arranged such that it can be displaced with two piston-cylinder arrangements, the piston-cylinder arrangements having pistons which are connected to each other and where a first cylinder is attached to the primary frame and a second cylinder is attached to the saddle, or whose cylinders are connected with each other and the first piston is attached to the primary frame and the second piston is attached to the saddle.

5. The container lift according to claim 4, wherein each saddle has pegs that are mounted in bearings in the primary frame.

6. The container lift according to claim 3, wherein each saddle comprises a lock holder on the side of the primary frame, which holder is arranged at its upper end such that it can swing around an axis that is parallel to the longitudinal axis, and wherein at least part of each saddle is arranged such that it can be displaced with two piston-cylinder arrangements, the piston-cylinder arrangements having pistons which are connected to each other and where a first cylinder is attached to the primary frame and a second cylinder is connected with the lock holders on each side of the primary frame, or whose cylinders are connected with each other and the first piston is attached to the primary frame and the second piston is connected with the lock holders.

7. The container lift according to claim 6, wherein the piston-cylinder arrangements are arranged under the primary frame.

* * * * *